US009211465B1

(12) United States Patent
Lambrinos

(10) Patent No.: US 9,211,465 B1
(45) Date of Patent: Dec. 15, 2015

(54) SPORT TRAINING BAG ATTACHMENT

(71) Applicant: Jon Lambrinos, Campbell, OH (US)

(72) Inventor: Jon Lambrinos, Campbell, OH (US)

( * ) Notice: Subject to any disclaimer, the term of this patent is extended or adjusted under 35 U.S.C. 154(b) by 35 days.

(21) Appl. No.: 14/449,505

(22) Filed: Aug. 1, 2014

(51) Int. Cl.
*A63B 69/22* (2006.01)
*A63B 69/24* (2006.01)
*A63B 69/34* (2006.01)
*A63B 69/20* (2006.01)

(52) U.S. Cl.
CPC ..... *A63B 69/34* (2013.01); *A63B 69/201* (2013.01)

(58) Field of Classification Search
CPC .... A63B 69/004; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2069/0042; A63B 2069/004; A63B 2243/0066; A63B 2243/007; A63B 2244/10; A63B 2244/102; A63B 2244/104; A63B 2244/106; A63B 2244/108
USPC ..... 482/83–90
See application file for complete search history.

(56) References Cited

U.S. PATENT DOCUMENTS 1,267,678 A * 5/1918 McArdle et al. ..... A63B 69/004 482/89
2,045,972 A * 6/1936 Tompkins ..... A63B 69/206 482/89
3,700,237 A * 10/1972 Kopp ..... A63B 69/345 473/444
4,093,212 A 6/1978 Jacques
4,491,315 A 1/1985 Dye
4,572,504 A * 2/1986 DiBartolo ..... A63B 69/004 482/83
5,183,450 A * 2/1993 Stelmach ..... A63B 69/004 473/442
5,263,912 A * 11/1993 Stelmach ..... A63B 69/004 473/442
5,281,191 A * 1/1994 DeSousa ..... A63B 69/34 473/442
5,697,872 A * 12/1997 Stronsick, Jr. ..... A63B 69/34 482/83
5,800,319 A * 9/1998 Choate ..... A63B 69/34 482/83
5,902,217 A * 5/1999 Schechner ..... A63B 69/201 482/83
6,033,348 A * 3/2000 Warshauer ..... A63B 69/004 482/83
6,063,011 A * 5/2000 Pelchat ..... A63B 69/004 482/83
6,302,831 B1 * 10/2001 Henry ..... A63B 69/004 482/83
D584,785 S * 1/2009 McDonald ..... D21/787
7,959,528 B1 * 6/2011 Wilkes ..... A63B 69/0002 473/451
D641,811 S 7/2011 Brenner et al.
D641,812 S 7/2011 Brenner et al.
8,033,963 B1 * 10/2011 Jones ..... A63B 21/062 482/100
8,876,671 B1 * 11/2014 Hurtato, Jr. ..... A63B 69/24 482/87
9,017,227 B1 * 4/2015 Vargas ..... A63B 69/34 482/83
2008/0032872 A1 2/2008 Nappier
2008/0182729 A1 * 7/2008 Ziska ..... A63B 69/34 482/89
2009/0264264 A1 10/2009 Reen
2012/0246884 A1 * 10/2012 Wilson ..... A63B 69/004 24/302
2012/0252637 A1 * 10/2012 Pellot ..... A63B 69/20 482/89
2014/0080681 A1 * 3/2014 Knight ..... A63B 69/34 482/83

* cited by examiner

*Primary Examiner* — Oren Ginsberg
*Assistant Examiner* — Gary D Urbiel Goldner
(74) *Attorney, Agent, or Firm* — Harpman & Harpman

(57) ABSTRACT

A training bag attachment on a heavy boxing bag for training boxing techniques, specifically an upper cut that requires an elevated preferably suspended target. The upper cut training bag attachment provides for multiple independent target punching bags spaced around the heavy bag. The target punching bags are vertically adjustable and spaced to be outstanding from the mounting bag surface for use. An elastic retainer assembly provides for automatic resilient return displacement after impact, affording a user multiple continuously resetting targets.

9 Claims, 5 Drawing Sheets

SPORT TRAINING BAG ATTACHMENT

BACKGROUND OF THE INVENTION

1. Technical Field

This invention relates to sports training, specifically boxing punching bags to provide for repetitive hitting by users to improve their accuracy and skill.

2. Description of Prior Art

Prior art devices of this type directed to boxing training for specific types of punching have been developed; see for example U.S. Pat. Nos. 4,093,212, 4,491,315, Design Pat. D641,811S and D641,812S, and U.S. Publications 2008/0032872A1 and 2009/0264264A1 and PCT Application WO94/28981.

In U.S. Pat. No. 4,093,212 a punching bag for practicing upper cuts can be seen having a bag on a horizontal arm, pivoted to a bracket attached to wall with a spring return.

U.S. Pat. No. 4,491,315 illustrates a training bag for boxing having multiple contoured bags suspended from a central support in two representations of anatomical sections of a head and body.

Design Pat. D641,811S and D641,812S by the same inventor disclose torso punching targets having a central upstanding main support arm from which is mounted a head and neck punching target and a torso punching target.

U.S. Publication 2008/0032872A1 shows a striking apparatus having a punching bag attached to a boxing heavy bag from a single strap attachment point.

U.S. Publication 2009/0264264A1 claims a martial art and boxing training apparatus having a series of unequal length segmented arms independently attached to a bag support rim on a boxing heavy bag with punching targets attached integrally to each of the respective free ends.

Finally, in PCT Patent Application WO 94/28981 an improved punching bag is claimed having a modified boxing heavy bag with an annular cantilevered indentation space inwardly from its upper end, affording a human body-like configuration to the bag onto which to punch.

SUMMARY OF THE INVENTION

A training attachment for boxing equipment that is removably secured to a boxing heavy bag having a number of identical attached and suspended independent target punching bags for practicing upper cuts. Each of the multiple target punching bags are pivotally secured by an annular mounting strap and each has an attached height adjustment support strap for adjustable vertical positioning on the heavy bag. Target punching bag spacers and resilient return lines assure proper target bag presentation positioning and afford rapid reset after being hit for continuous sequential use.

DESCRIPTION OF THE PREFERRED EMBODIMENT

Figure 1:
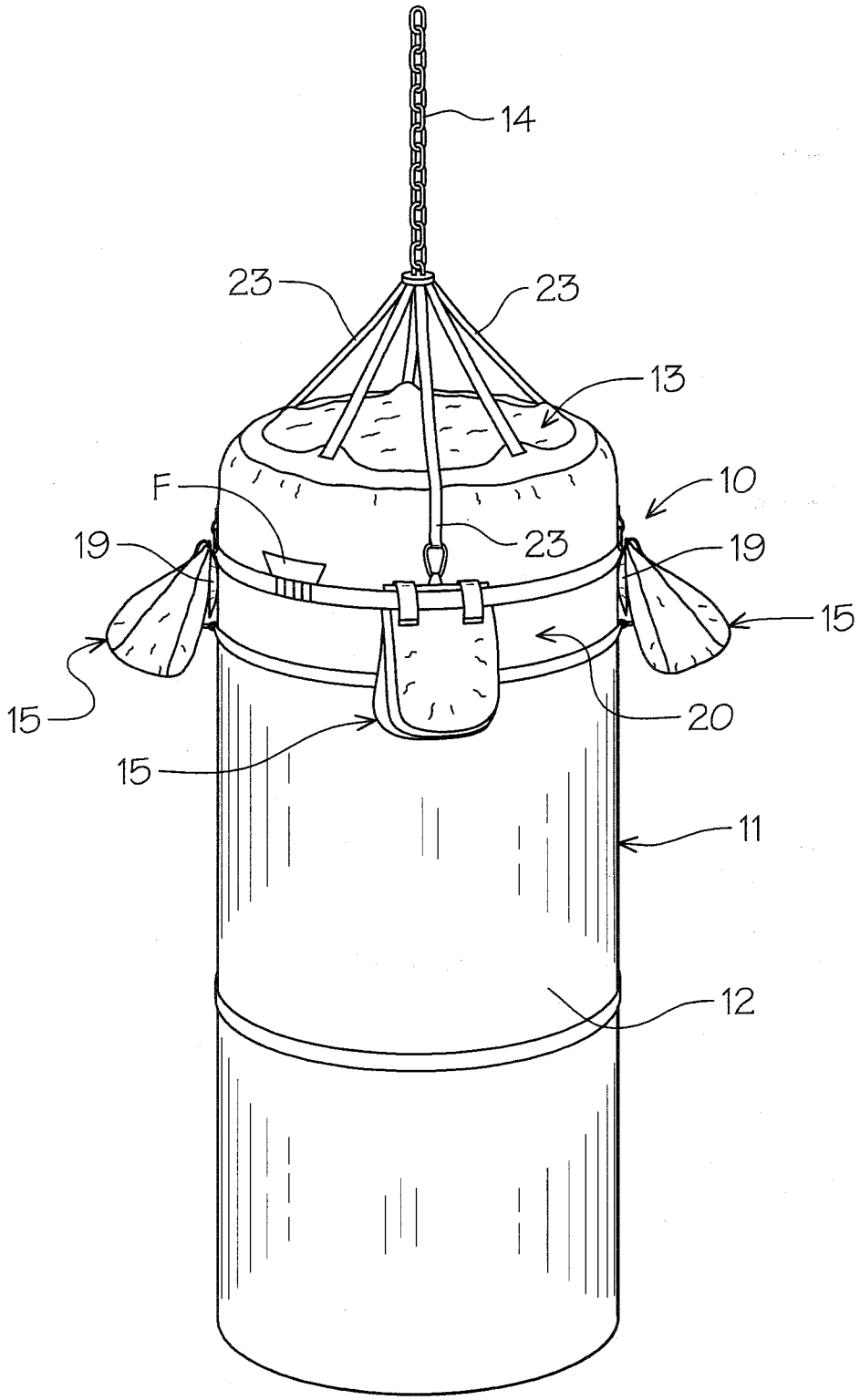
FIG. 1 is a perspective view of the boxing bag attachment on a suspended heavy boxing bag.
Figure 2:
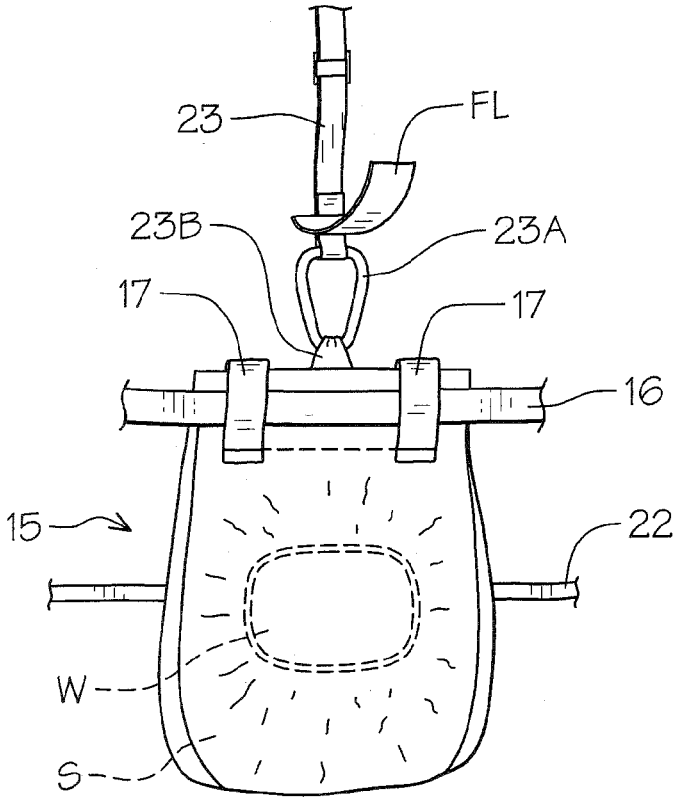
FIG. 2 is an enlarged front elevational view of a single target punching bag thereon.

Referring FIGS. 1 and 2 of the drawings, a boxing upper cut training bag assembly 10 of the invention can be seen mounted on a suspended boxing heavy bag 11. In this example, the heavy bag 11 has a main cylindrical padded body member 12 suspended by multiple straps 13 to a central support line 14, interengaging and extending therefrom as will be well-known and understand by those skilled in the art.

The training bag assembly 10 of the invention has one or more independent target punching bags 15, each pivotally secured by an annular mounting bag strap 16 that adjustably extends around the cylinder body member 12 of the heavy bag 11, as best seen in FIG. 1 of the drawings. Each of the independent target punching bags 15 is of a generally rectangular outside configuration within this example fabric mounting loops 17 thereon, thru which the suspension bag strap 16 extends allowing each target punching bags 15 to move independently during impact, as will be described in greater detail hereinafter.

The target punching bags 15 are filled with padding and may have a selective interchangeable weight W illustrated in broken lines encapsulated there within, depending on the user's preference.

Figure 5:
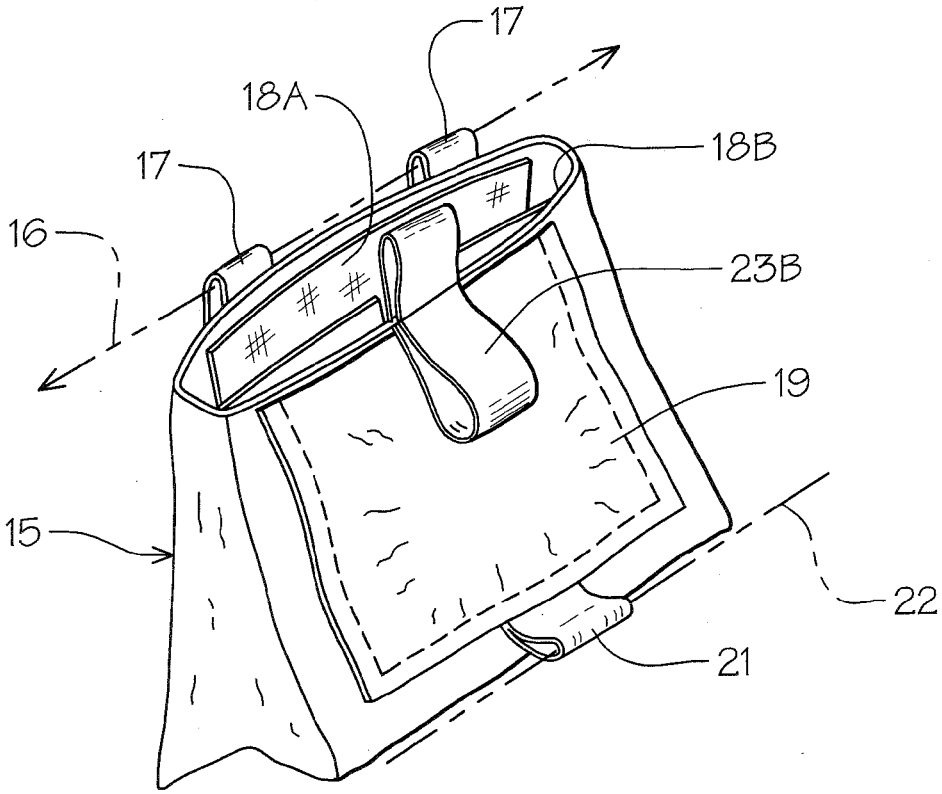
FIG. 5 is an enlarged perspective view of the target punching bag in open access position for selective interchangeable weight insertion.

The target punching bag 15 has an access closure opening at 18, best illustrated in FIG. 5 of the drawings, with hook and loop fasteners A and B on oppositely disposed surfaces which provide for weight W access for interchangeability as discussed.

Figure 3:
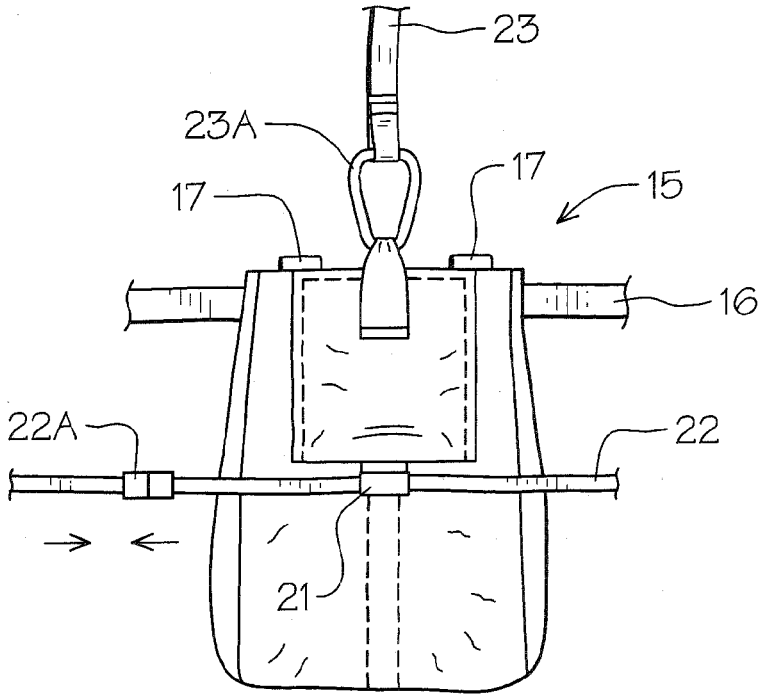
FIG. 3 is an enlarged rear elevational view thereof.
Figure 4:
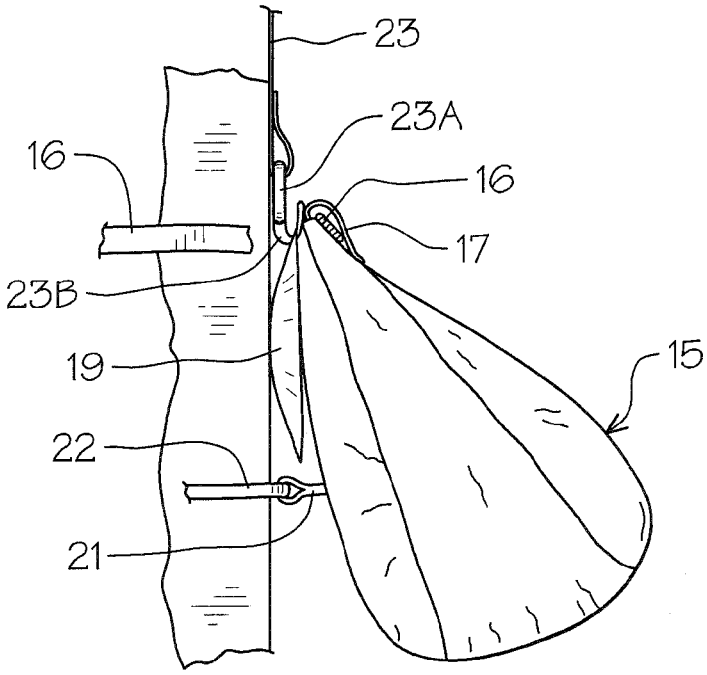
FIG. 4 is an enlarged side elevational view of a target training bag as attached to a portion of the suspended heavy boxing bag.
Figure 6:
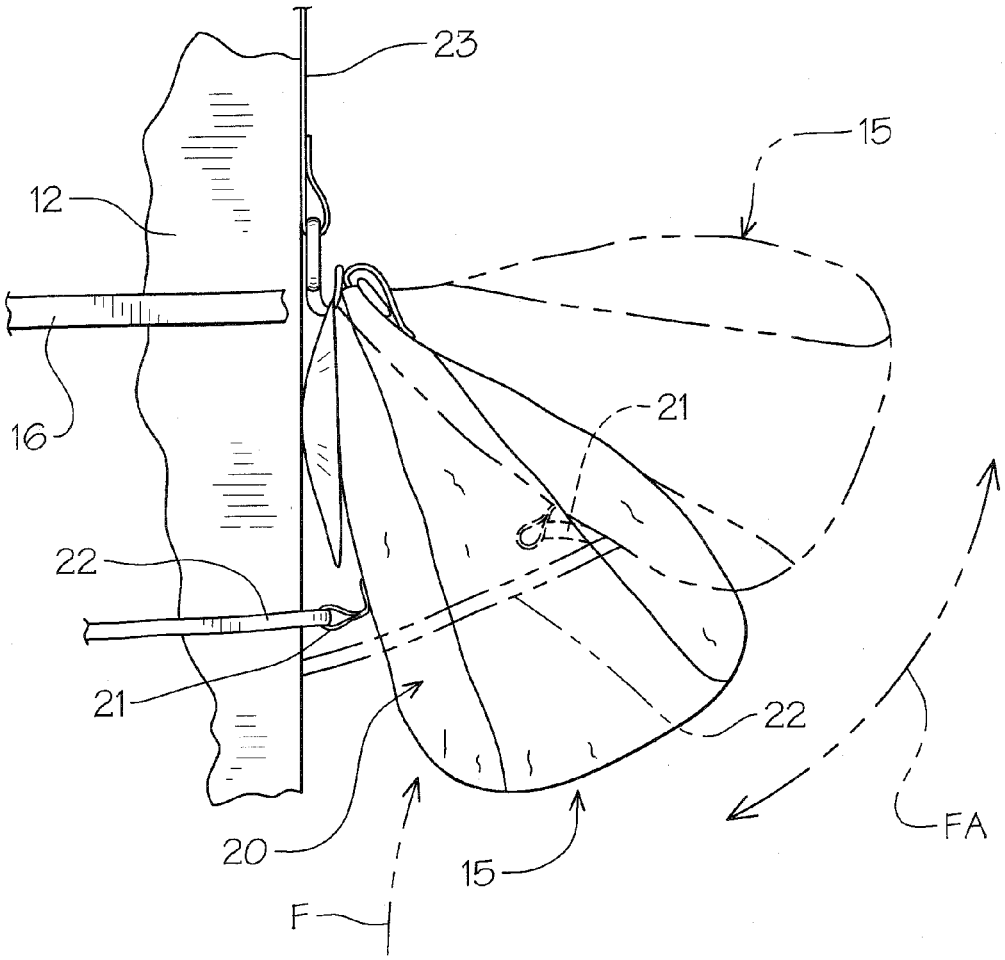
FIG. 6 is an enlarged side elevational view of a single target training bag as attached in solid lines and in broken lines in extended resilient return position during use.

It will be seen that each of the target punching bags 15 has an attached spacing element 19 that extends therefrom, so as to be engaged against the punching bags 11 mounting surface 11 to hold the target punching bag 15 in annular space-relation thereto. Such bag spacing provides a proper upper cut training target for the user (not shown) but in use as seen in FIG. 6 of the drawings. Each of the target punching bags 15 has an attachment loop 21 through which a resilient return cord 22 extends around the heavy bag 11 in vertically spaced parallel relation to the hereinbefore described mounting bag strap 16. The return cord 22 is adjustably secured so as to impart varying elasticity by foreshortening about the heavy bag 11 by interadjustable fastener 22A as seen in FIG. 3 of the drawings.

The resilient return cord 22 is so positioned to resiliently retain the target punching bag 15 against the bag's mounting surface 20, and therefore selectively return the target punching bag 15 thereto after being hit and pivotally displaced during use, as indicated by the broken lines and directional force arrows in FIG. 6 of the drawings.

Multiple height adjustable suspension straps 23 extend from each of the target punch bags 15 of the training bag assembly 10, utilizing an access fitting 23A through an attachment loop 23B securing to the bag and extends up to a primary attachment ring fitting 24 which is releasably secured on to the bag suspension support 14 of its vertical tether.

It will be evident from the above description that by selectively adjusting the adjustable suspension straps 23, each of the target punching bags 15 and correspondingly the training bag assembly 10 can be positioned at a vertical height on the suspended heavy bag 11 to correspond with the (user's) height requirement to achieve a proper upper cut practice in the sport of boxing.

Correspondingly, referring to the training bag assembly's annular mounting bag strap 16 is secured around the heavy bag 11 by into an attachment fitting 26 to facilitate the adjustable attachment thereto, and in this example may have a protective cover flap F that would overlie the fitting so as to protect same from direct contact by the boxer, which may occur during a workout.

It will therefore be seen that during use a boxer (not shown) selects the selective target punching bag 15, as illustrated in broken and solid lines in FIG. 6 of the drawings, so as to practice boxing "upper cut" punches. The target punching bag 15 upon impact by the boxer will pivot upwardly on the attachment strap 16 as illustrated in broken lines and force arrow FA and then resiliently return to the pre-punch position against the heavy bag surface 20 automatically by the resilient restraint of the hereinbefore described retainment cord thus repositioning the target punching bag rapidly for another hit.

By having multiple target punching bags 15 spaced annularly around the perimeter of the suspended heavyweight bag 11, a more natural and affective workout can be achieved as the user, and to some extent the bags 15 move about providing for a more realistic training simulation.

Referring again to FIG. 6 of the drawings, an alternate resilient bag retaining element 27 can be seen in broken lines, which are the functional equivalent of the elastic cord 22 and be connected directly to the back of each of the independent target punching bags 15 of resilient material as opposed to the continuous elastic cord 22 as hereinbefore described while achieving the same effective automatic return during use.

Figure 7:
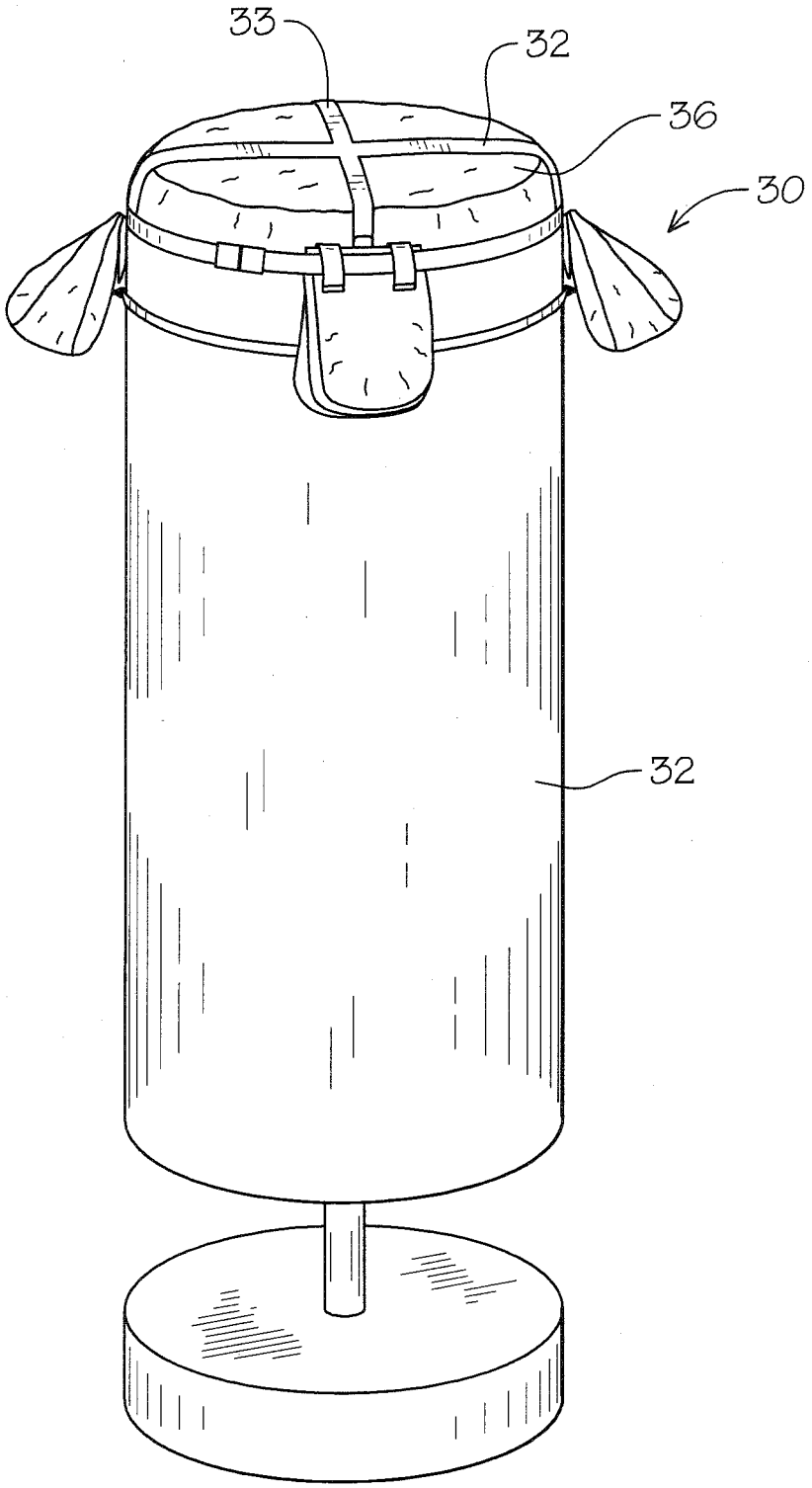
FIG. 7 is a perspective view of an alternate form of the multiple target training bag attachment for a free-standing heavy boxing training bag.

Referring now to FIG. 7 of the drawings, an alternate boxing upper cut training bag assembly 30 can be seen, wherein the multiple target punching bags 15 and basic mounting and resilient structures are identical to that of the primary form of the invention with an alternate bag support attachment 31 provided to fit on non-unsuspended self-supporting workout bag 32 as illustrated. The alternate support attachment 31 has in this example a pair of right angularly crossed bag engagement bands 33 and 34 that extend from oppositely disposed attachment points from an annular bag attachment strap 34. This arrangement can therefore be placed over the top 36 of the self-supporting workout bag 31 as seen with corresponding multiple target punching bags 38 pivotally secured thereto as hereinbefore described.

It will be apparent that the number and positioning of the individual target punching bags 15 can be varied as well as the hereinbefore described adjustability imparted to the structure that affords a variety of adjustments to accommodate bag attachment variations inherent therewithin, and therefore that respective training bag assemblies 10 and 31 provide a number of user attachment scenarios and thus viability and usability in multiple environments.

It will therefore be seen that a new and novel fuel training bag attachment assembly 10 has been illustrated and described, and will be apparent to those skilled in the art that various changes and modification may be made thereto without departing from the spirit of the invention.

Therefore I claim:

1. A sports training apparatus assembly comprising: a suspension and mounting harness having a mounting bag strap; one or more target punching bags suspended from said mounting bag strap; resilient bag retaining means on said suspension and mounting harness and interconnected to said one or more target punching bags; and means for spacing a portion of said one or more target punching bags in relation to a mounting surface for ease of angular access during use, wherein said mounting surface comprises a heavy punching bag.

2. The sports training apparatus assembly set forth in claim 1 wherein said mounting bag strap extends through one or more support loops on said respective one or more target punching bags.

3. The sports training apparatus assembly set forth in claim 1 wherein the resilient bag retaining means comprises: an adjustable elastic cord vertically spaced in relation to said mounting bag strap and in communication with said respective one or more target punching bags.

4. The sports training apparatus assembly set forth in claim 1 wherein said one or more target punching bags comprises:

a respective flexible material enclosure having an opening therein, and a selective closure means on said opening.

5. The sports training apparatus assembly set forth in claim 1 wherein said one or more target punching bags further comprises:

resilient filling and interchangeable weights therewithin.

6. The sports training apparatus assembly set forth in claim 1 wherein said suspension and mounting harness further comprises:

length adjustable suspension bag support straps, said length adjustable suspension bag support straps extending from said respective one or more target punching bags to said mounting surface.

7. The sports training apparatus assembly set forth in claim 1 wherein said mounting bag strap has adjustable end to end fasteners for engagement annularly about said heavy punching bag.

8. The sports training apparatus assembly set forth in claim 1 wherein said means for spacing a portion of said one or more target punching bags in relation to said mounting surface comprises:

a padding element secured on a portion of said one or more target punching bags.

9. The sports training apparatus assembly set forth in claim 1 wherein said heavy punching bag is a self-supporting training bag and said suspension and mounting harness further comprises: a suspension bag strap having a pair of oppositely disposed attached cross bag support bands, engageable over a top of said self-supporting training bag.

* * * * *